US008288961B2

(12) United States Patent
Chen et al.

(10) Patent No.: US 8,288,961 B2
(45) Date of Patent: Oct. 16, 2012

(54) LED BACKLIGHT DRIVING MODULE

(75) Inventors: Wen-Sheng Chen, Taipei (TW); Chih-Lung Liu, Taoyuan (TW); Ming-An Chiu, Cigu Township, Tainan County (TW)

(73) Assignees: Silitek Electronic (Guangzhou) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 174 days.

(21) Appl. No.: 12/842,376

(22) Filed: Jul. 23, 2010

(65) Prior Publication Data

US 2011/0260645 A1 Oct. 27, 2011

(30) Foreign Application Priority Data

Apr. 26, 2010 (CN) ..... 2010 1 0155409

(51) Int. Cl.
*H05B 37/02* (2006.01)

(52) U.S. Cl. ..... 315/294; 315/274; 315/222; 315/307; 315/282

(58) Field of Classification Search ..... 315/222, 315/246, 274, 276, 282, 283, 294, 307
See application file for complete search history.

(56) References Cited

U.S. PATENT DOCUMENTS

| | | | | |
|---|---|---|---|---|
| 8,080,947 | B2 * | 12/2011 | Chang et al. | 315/282 |
| 2011/0227492 | A1 * | 9/2011 | Du et al. | 315/186 |
| 2011/0248638 | A1 * | 10/2011 | Aso | 315/185 R |
| 2011/0316449 | A1 * | 12/2011 | Imanaka | 315/307 |

* cited by examiner

*Primary Examiner* — Don Le
(74) *Attorney, Agent, or Firm* — Li&Cai Intellectual Property (USA) Office

(57) ABSTRACT

The instant disclosure relates to a LED backlight driving module. The driving module utilizes a plurality of second power isolation transformers interconnected to each other in series and connected to a secondary winding of a first power isolation transformer in parallel to produce a plurality of second driving signals with uniform current, and driving corresponding LED light bars with uniform brightness. Optionally, a base voltage circuit can be used to provide a base voltage with negative voltage level on the other end of LED light bars, so as to lower the positive voltage level of the second driving signals. Thus, it is beneficial that the LED backlight driving module provides higher power conversion efficiency and has lower design cost.

10 Claims, 9 Drawing Sheets

LED BACKLIGHT DRIVING MODULE

BACKGROUND OF THE INVENTION

1. Field of the Invention

The instant disclosure relates to an LED backlight driving module, in particular, the invention relates to a LED backlight driving module having a uniform current output in each LED light bar.

2. Description of Related Art

In recent years, LED backlight is being increasingly applied to the fabrication of large-size LCD display apparatus. Furthermore, the LED backlight provides a solution to environmental protection and power saving since the LED devices do not contain heavy metals such as mercury. Relevant statistics shows that the LED backlight technology is rapidly replacing traditional backlight units with a growing market penetration rate from 3% in 2009 to 20% in 2010.

Currently, LED backlight units can be categorized into direct type and edge type. The direct-type LED backlight units have the advantage of partial light dimming capability to comply with specific video requirements, thus achieving better performance in power-consumption, higher dynamic contrast, and greater color domain. However, the direct-type LED backlight requires more LED units and more complicated driving modules. The edge-type LED backlight, on the other hand, excels in its adaptability in thinner LCD displays. The edge-type LED backlight also requires fewer LED units and less complicated driving modules, thus has a lower production cost. However, the edge-type LED backlight can not be performed two-dimensional partial dimming, and has a poorer dynamic contrast.

The driving modules of the conventional edge-type LED backlight units can be divided into DC-DC current conversion circuits, as shown in FIG. 1, or linear current regulator and PWM dimming circuits, as shown in FIG. 2. The driving module is employed to uniformly drive a plurality of LED light bars.

Reference is made to FIG. 1, which shows a driving module 10 of a conventional LED backlight. A power isolation transformer 12 of a power circuit 19 is incorporated into the driving module 10. The power isolation transformer 12 performs a voltage conversion on a signal from a main power stage 11. An output rectifier and filter 13 rectifies and filters the power stage signal, generating a driving power signal. A plurality of DC-DC converters (#1, #2, #3 . . . #N) 16 subsequently performs a second voltage conversion on the driving power signals. The converted signal is then adapted to drive a plurality of LED light bars (#1, #2, #3 . . . #N) 17 to produce light. A plurality of PWM dimming and current feedback circuits (#1, #2, #3 . . . #N) 18 are incorporated to modulate the luminance of the LED units and to stabilize the LED current. A feedback circuit 14 and a PWM controller 15 are adapted to provide feedback control, thus stabilizing the driving power signal of the power circuit 19.

The cost and area used by circuit board will increase when the number of the LED light bars 17 increases and the corresponding DC-DC converters 16 need to reach the same number as well. Furthermore, interference might occur if the operation frequency of the DC-DC converter 16 is not synchronized with the main power stage 11. Still further, the DC-DC converter 16 generates additional electromagnetic radiation interference (EMI).

Reference is now made to FIG. 2, which shows the topology of a conventional driving module 20 similar to the module 10 of FIG. 1. Module 20 uses a plurality of linear current regulator and PWM dimming circuits (#1, #2, #3 . . . #N) 21 to replace the DC-DC converter 16 and the feedback circuit 18.

Furthermore, when the individual differences among the plural LED light bars 17 are large, the extra loss of the system would also increase because the driving module 20 uses the linear current regulator and PWM dimming circuit 21. Yet further, if the number of LED dies in-series connected in one LED light bar 17 increases, the power consumption and waste heat of each linear current regulator and PWM dimming circuit 21 also increase. Thus, additional cooling fins would be needed to maintain normal operation. Therefore, the number of the connected LED dies requires an upper limit in order to prevent over-heating and failure of the linear current regulator and PWM dimming circuit 21, and allows the cooling fins to have a best cooling efficiency.

SUMMARY OF THE INVENTION

The instant disclosure relates to a LED backlight driving module, which utilizes primary winding of a plurality of second power isolation transformers, and those primary winding are interconnected in series in order to implement a uniform current in each LED light bar.

The LED backlight driving module uses a base voltage generation circuit to provide a base voltage with a negative voltage level to reduce the positive voltage level of the second driving signal provided by the second stage power isolation transformer.

According to one embodiment of the instant disclosure, the provided is a LED backlight driving module for driving a plurality of LED light bars. The driving module includes a main power stage used for generating a power signal; a first stage isolation transformer unit coupled to the main power stage for receiving the power signal and outputting a first driving signal; a second stage isolation transformer unit having a plurality of second stage power isolation transformers. The primary winding of each second power isolation transformer is interconnected one by one in series. The second stage isolation transformer unit is connected to the first secondary winding of the first stage isolation transformer unit in parallel. According to the first driving signal, a second driving signal with corresponding secondary winding of each second stage power isolation transformer is generated. Further, the plurality of output rectifiers and filters are separately coupled to their corresponding secondary winding of the second stage power isolation transformers, so as to perform rectification and filtering operation on the corresponding second driving signals, and therefore to drive their coupled LED light bars.

In accordance with the embodiment of the invention, a LED backlight driving module is provided to drive the plurality of LED light bars. The driving module particularly includes a main power stage for generating a power signal; a first stage isolation transformer unit coupled to the main power stage for receiving the power signal. In which, a first secondary-winding is included to induce a first driving signal. Further, a second stage isolation transformer unit having a plurality of second stage power isolation transformers is also included. In which, the first secondary-winding of the first stage isolation transformer unit and the second stage isolation transformer unit are connected in parallel.

According to the first driving signal, the secondary winding of each second stage power isolation transformer generates a corresponding second driving signal. Furthermore, the output rectifiers and filters are separately coupled to their corresponding secondary winding of the second stage power isolation transformers, so as to perform rectification and filtering operations to the second driving signals and then separately applied on one side of their coupled LED light bars.

Further, a base voltage generation circuit is included. A negative-voltage terminal of a second secondary-winding of the first stage isolation transformer unit is used to induce a base voltage. The negative-voltage terminal of the base voltage generation circuit is coupled to the other sides of the LED light bars, so as to drive the LED light bars with the second driving signals.

In accordance with one more embodiment of the invention, a LED backlight driving module is provided to drive the LED light bars. The driving module includes a main power stage for generating a power signal; a first stage isolation transformer unit coupled to the main power stage for receiving the power signal. Therefore, a first driving signal is outputted. A second stage isolation transformer unit having a plurality of second power isolation transformers is also included. The primary winding of each second stage power isolation transformer is in-series connected one by one. Further, those primary windings are connected with a first secondary-winding of the first stage isolation transformer unit in parallel.

According to the first driving signal, the secondary winding of each second stage power isolation transformer generates a corresponding second driving signal. A plurality of output rectifiers and filters are separately coupled to the secondary winding of the second stage power isolation transformer, so as to perform rectification and filtering operation on the second driving signal, and to one side of the their coupled LED light bars.

Furthermore, a base voltage generation circuit is included. A negative-voltage terminal of a second secondary-winding of the first stage isolation transformer unit is used to induce a base voltage. The negative-voltage terminal of the base voltage generation circuit is then coupled to the other sides of the LED light bars, and to drive the plural LED light bars with the second driving signals.

In particular, the LED backlight driving module has the advantages that:

1. The driving module has higher power conversion efficiency than the conventional circuit topologies;
2. The driving module has lower design cost;
3. The driving module adopts transformers to balance the LED light bars' currents, therefore no extra EMI radiation is generated;
4. The driving module doesn't require any additional cooling fin;
5. The complexity of circuit is irrelevant to the number of LED dies in the LED light bar;
6. Better capability of making uniform currents among the LED light bars.

These and other various advantages and features of the instant disclosure will become apparent from the following descriptions and claims, in conjunction with the appended drawings.

DESCRIPTION OF THE PREFERRED EMBODIMENTS

Figure 1:
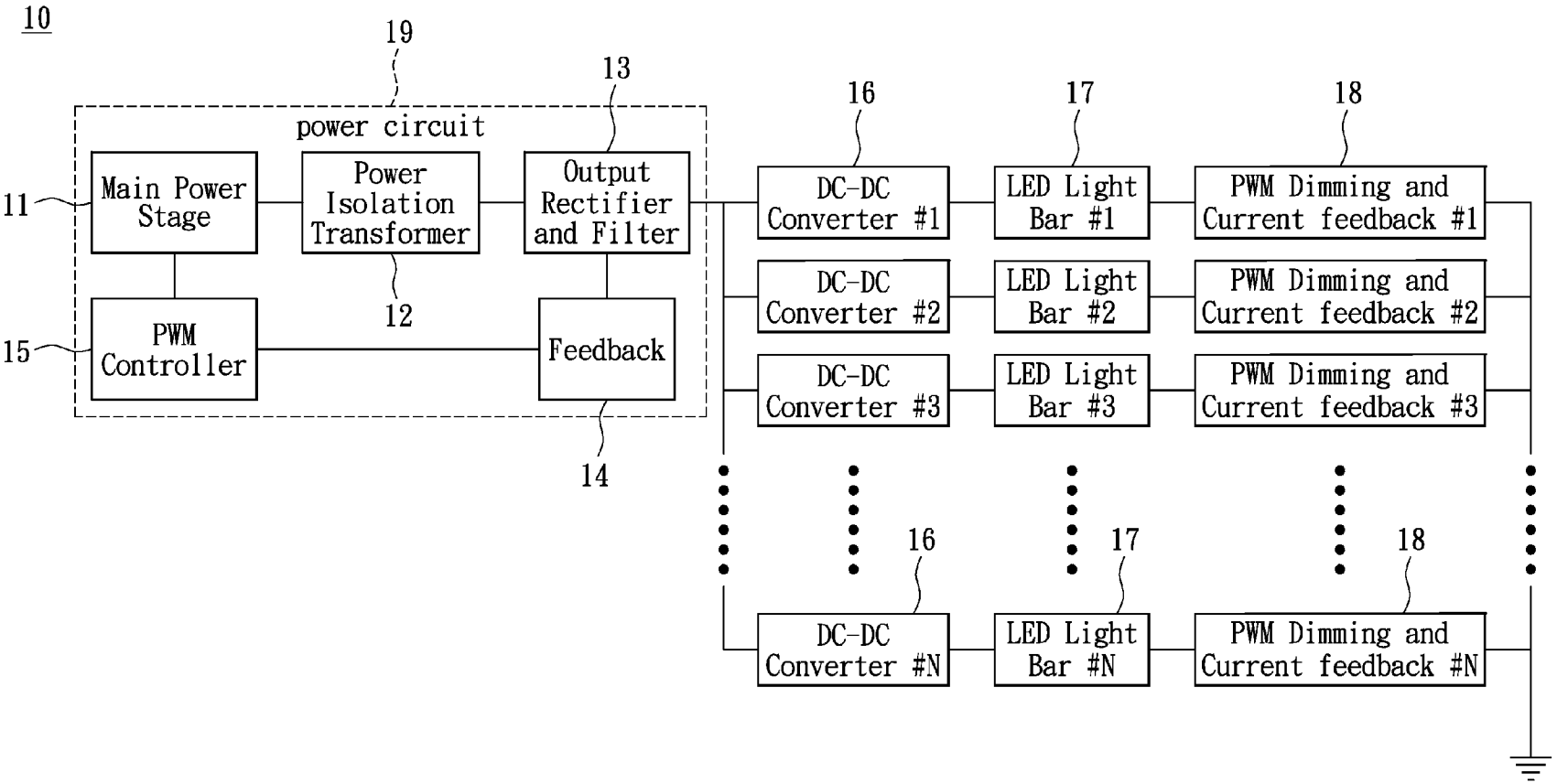
FIG. 1 shows a block diagram of a conventional LED backlight driving module using DC-DC converters.
Figure 2:
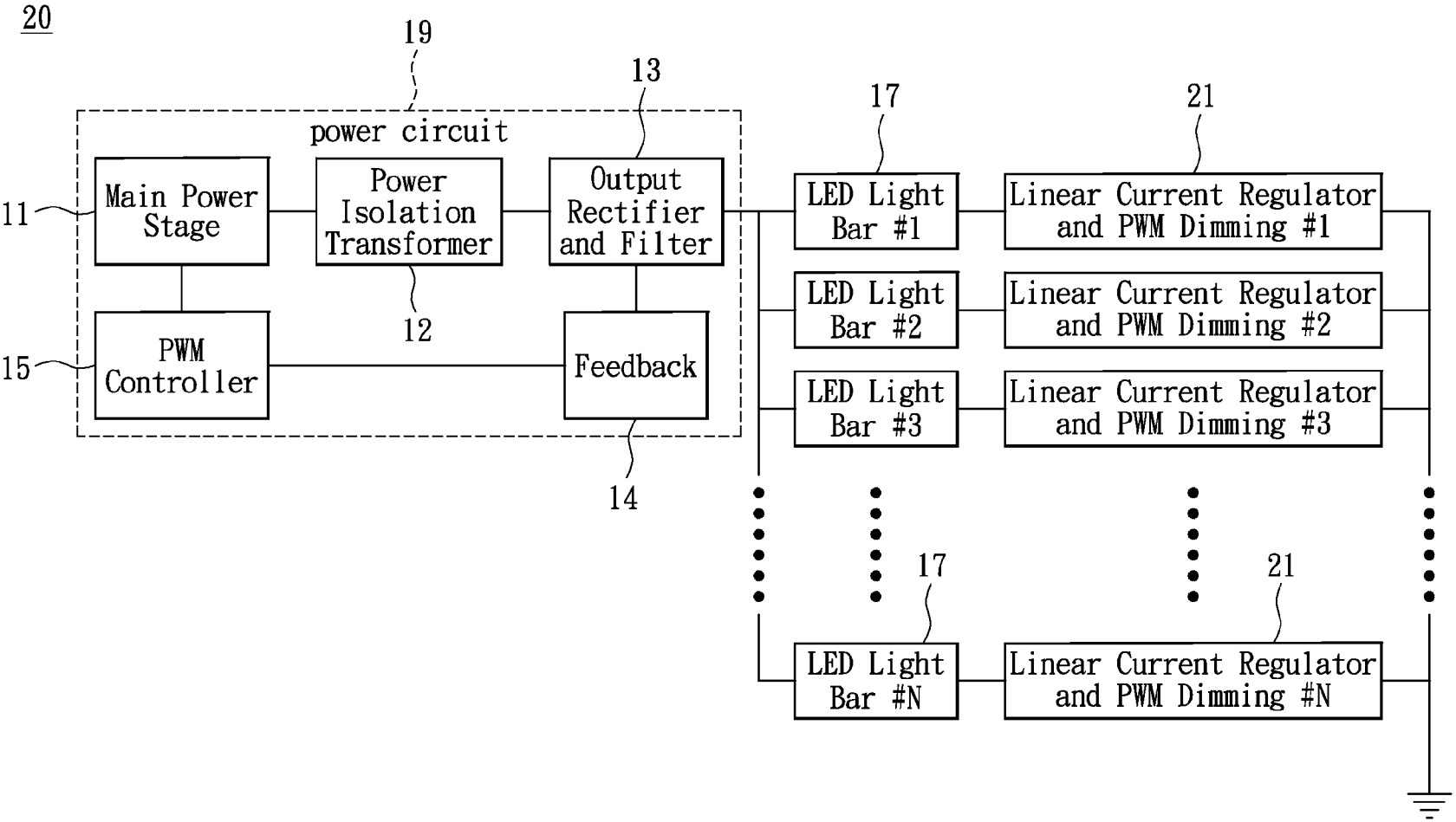
FIG. 2 is a block diagram illustrating a conventional LED backlight driving module using linear current regulators.
Figure 3:
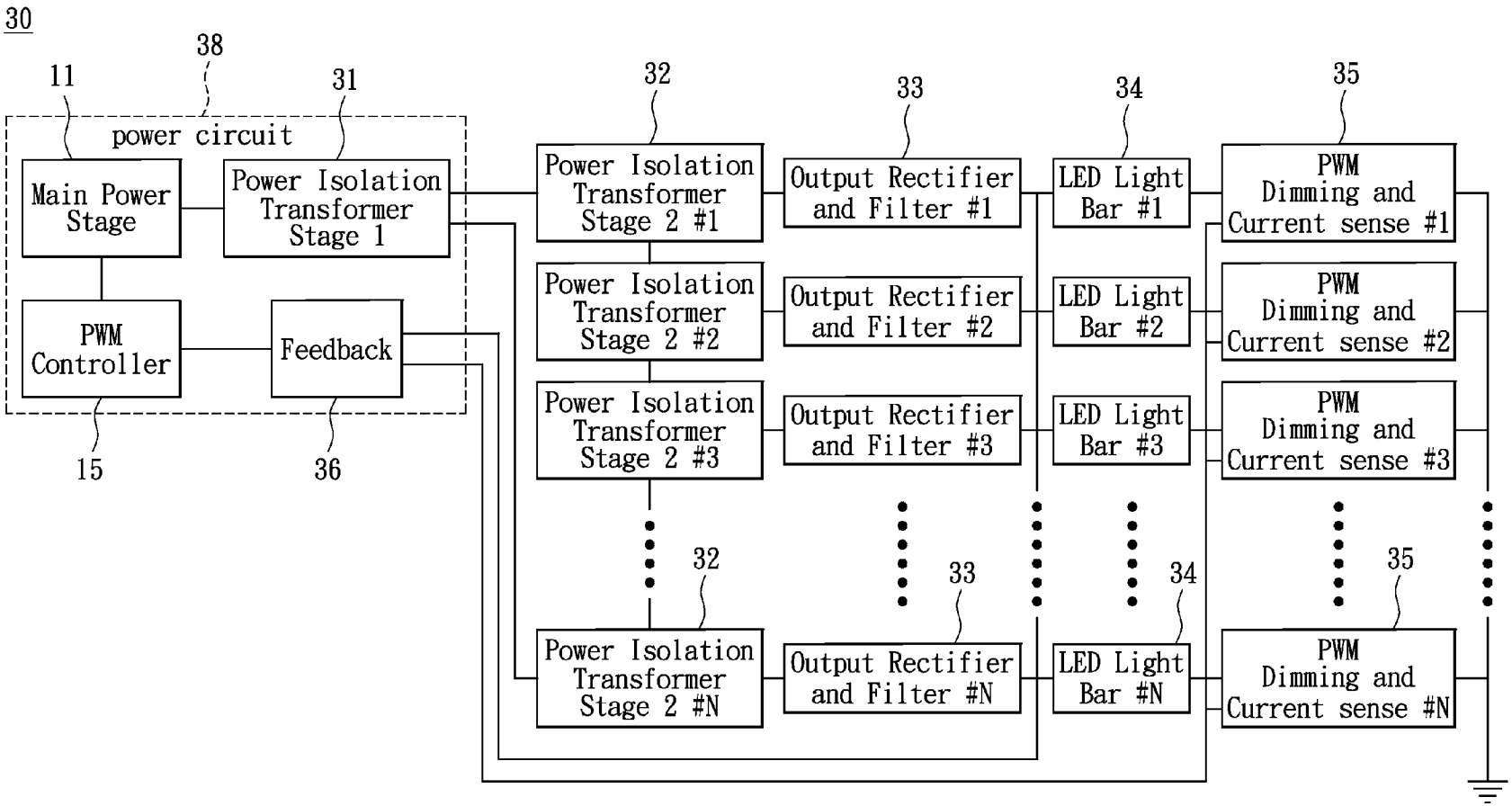
FIG. 3 is a block diagram of first embodiment of the LED backlight driving module in accordance with the instant disclosure.

Reference is made to FIG. 3 illustrating a first embodiment of the LED backlight driving module 30 in accordance with the instant disclosure. The driving module 30 includes a main power stage 11, a first stage isolation transformer unit, a second stage isolation transformer unit, a plurality of output rectifiers and filters (#1, #2, #3 . . . #N) 33, a plurality of LED light bars (#1, #2, #3 . . . #N) 34, a plurality of PWM Dimming and Current sensors (#1, #2, #3 . . . #N) 35, a feedback circuit 36, and a PWM controller 15.

The first stage isolation transformer unit is preferably a first power isolation transformer 31, and the second stage isolation transformer unit is preferably a plurality of second power isolation transformers 32. The power circuit 38 includes the main power stage 11, the first power isolation transformer 31, the feedback circuit 36, and a PWM controller 15. The main power stage 11 may be a generator or a receiver of high-voltage direct current power signal. To the skilled person in the related art, the power circuit 38 may be embodiment by introducing a flyback converter, or any other conventional topology of the power circuit.

The main power stage 11 of the power circuit 38 generates a power signal. Then a first voltage conversion is performed by the first power isolation transformer 31 generating a first driving signal. A second voltage conversion is then performed on the first driving signal by a plurality of the second power isolation transformers (#1, #2, #3 . . . #N) 32. The corresponding output rectifier and filter 33 performs rectification and filtering operation to generate a plurality of second driving and feedback voltage signals.

In particular, the second driving signals drive the corresponding LED light bars 34 to produce light. Through the PWM Dimming and Current sensors 35, the luminance of the LED light bars may be modulated, and a feedback current signal is generated. Further, the feedback circuit 36 can detect these feedback current and feedback voltage signals. The PWM controller 15, on the other hand, controls these feedback signals in order to stabilize the output voltage of the first driving signal of the power circuit 38.

A LED light bar 34 may include a plurality of in-series or in-parallel connected LED dies. Each LED light bar may correspondingly connect to the second power isolation transformer 32, the output rectifier and filter 33, and the PWM Dimming and Current sensor 35. The second power isolation transformers 32 are interconnected in series, and connected to a secondary winding of the first power isolation transformer 31 in parallel. Thus, the power isolation transformers 32 may induce second driving signals with the same current value. The uniformity of current among each light bar is thus achieved.

The signal from the main power stage 11 is converted by the first power isolation transformer 31 into a first driving signal with a lower voltage. Because both the first stage and second stage isolation transformer units have higher power conversion efficiency, their power loss after the power conversion is lower. Further, the plurality of second power isolation transformers 32 subsequently convert the first driving signal into a second voltage signal having a suitable voltage and an uniform current by their series connections. Because the voltage level of the first driving signal is reduced during conversion by the first stage isolation transformer unit, the second stage isolation transformer unit may employ transformer winding with lower voltage-rating to save production cost. Furthermore, because the voltage conversion range is smaller, the power loss of the system can also be kept minimal Thus, the driving module 30 can obtain great power conversion efficiency without requiring additional cooling fins, thus further reducing design costs.

The plurality of the second power isolation transformers 32 which are interconnected in series conduct the second driving signals in a uniform current, so as to drive the LED light bars 34 to light uniformly. The driving module 30 is applied to drive more LED light bars 34, or to drive the LED light bar 34 with more LED dies. The cost may be reduced as the driving module does not use the complicated circuit.

Figure 4:
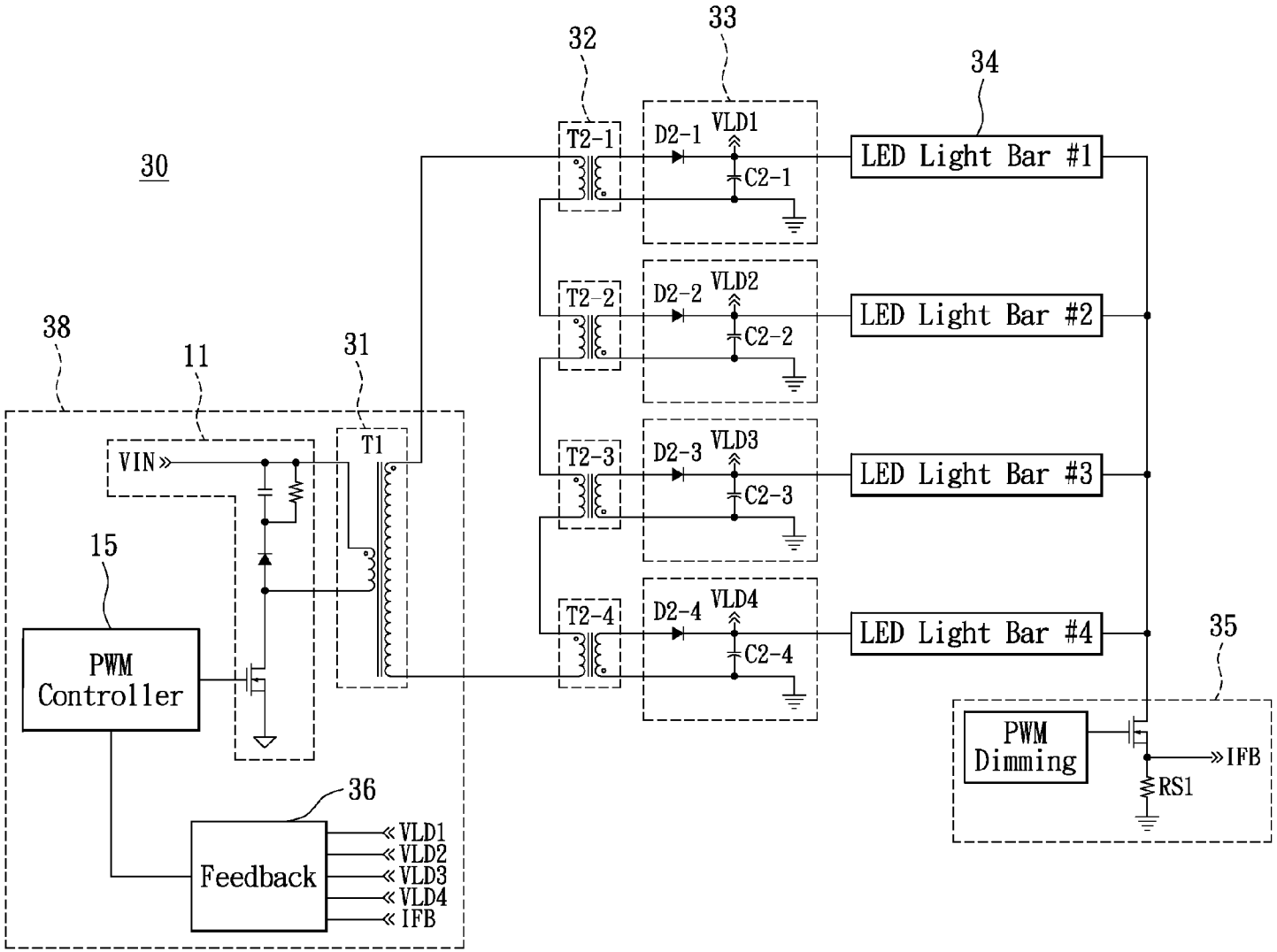
FIG. 4 shows a circuit diagram example of the LED backlight driving module of the first embodiment in accordance with the instant disclosure.

Next, reference is made to FIG. 4 which shows a circuit implement of the driving module 30 of FIG. 3. In which, each of the first power isolation transformer 31 and the plurality of second power isolation transformers 32 has one winding. The primary winding for each of the second power isolation transformers 32 is connected one by one in series. The second power isolation transformers 32 are connected to a secondary winding of the first power isolation transformer 31 in parallel.

Based on the described connections, the current induced by the secondary winding of the first power isolation transformer 31 will flow through the primary winding of each second power isolation transformer 32 in order. Thus the current induced by the secondary winding of each second power isolation transformer 32 will be the same and the related second driving signal may implement a uniform current, and drive the LED light bars 34 with a uniform light.

Furthermore, the PWM Dimming and Current sensor 35 adopts a current sensing circuit RS 1 to senses a feedback current signal, and feeds back to the feedback circuit 36. In the meantime, the feedback voltage signal for each corresponding LED light bar 34 is retrieved from the plural output rectifiers and filters 33. The feedback voltage signal is then fed back to the feedback circuit 36. The PWM controller 15 is used to modulate and stabilize the first driving signal generated by the power circuit 38.

In practice, in accordance with the instant disclosure, the number of LED light bars 34 and its corresponding second power isolation transformer 32, output rectifier and filter 33 are adjustable, so as to expand or reduce the required number of the LED light bars 34.

Figure 5:
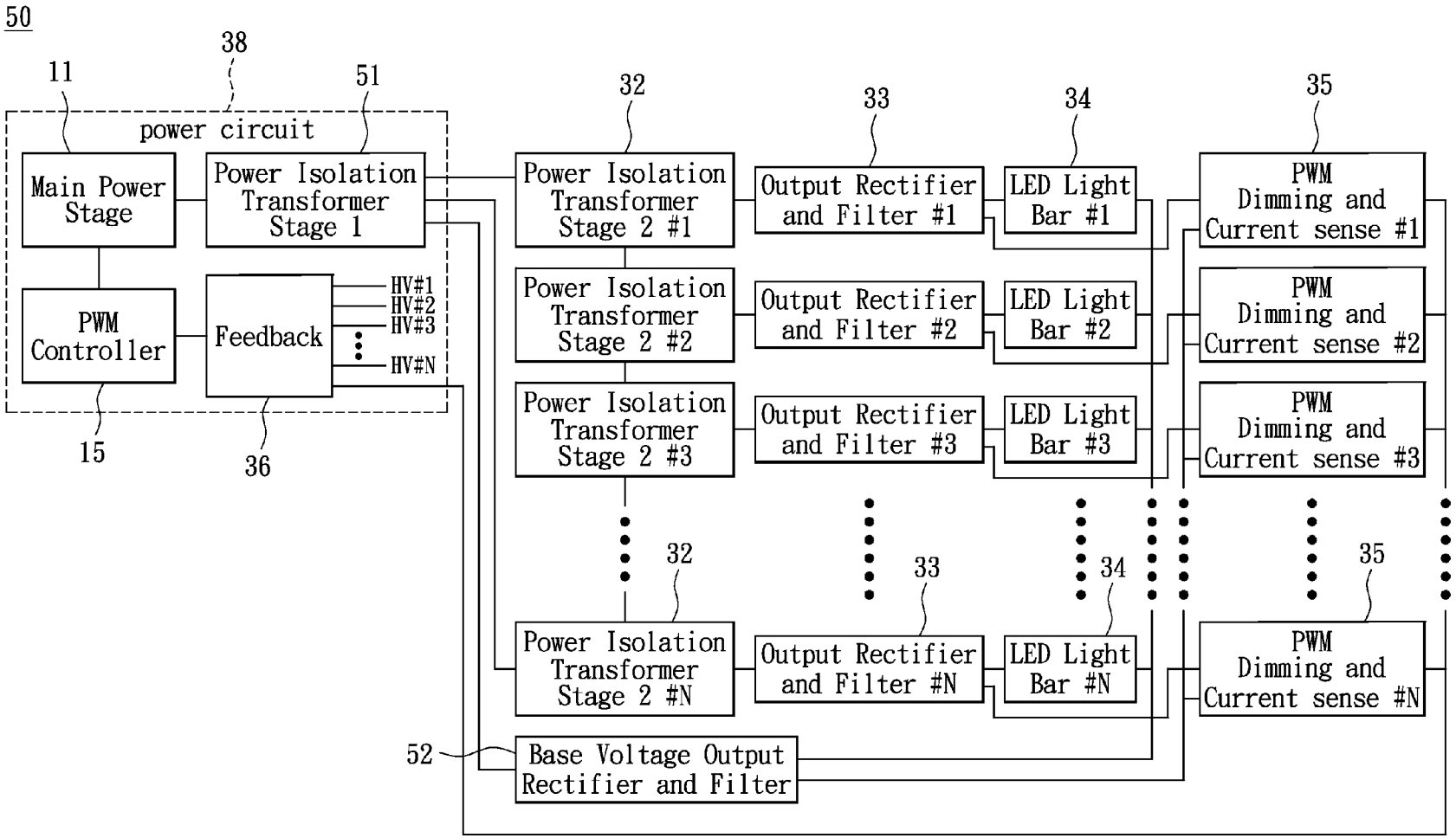
FIG. 5 Illustrates the block diagram of the LED backlight driving module of the second embodiment in accordance with the instant disclosure.

Reference is made to FIG. 5 illustrating a second embodiment regarding a driving module 50 of a LED backlight which has a base voltage. The difference between this driving module 50 and the driving module 30 in the first embodiment includes that the first power isolation transformer 51 of the first stage isolation transformer unit has the first secondary-winding and the second secondary-winding. The difference further includes that a base voltage output rectifier and filter 52 which uses the second secondary-winding of first power isolation transformer 51 to generate a base voltage signal, and the base voltage signal is coupled to the plural LED light bars 34 for having a sufficient voltage difference.

The described base voltage signal is the signal having a negative voltage level. By applying it, it can reduce the voltage level of the positive second driving signal performed on the LED light bars 34, and the handling power of the second power isolation transformer 32 can thus be decreased for reducing the design cost thereof.

The LED light bars 34 are composed of in-series interconnected plural LED dies. Each LED has its breakover voltage with a base level. It is noted that the breakover voltage of a white-light LED is specified as 3.3V, and the breakover voltage is distributed around ±10%. The instant disclosure is featured that a concept of an base voltage is introduced. As long as the voltage difference after the base voltage is deducted from a total voltage of the LED light bars 34 is restricted within 1.5 to 2.5 times of the overall LED breakover voltage errors. Thus, a uniform current can be achieved.

Furthermore, since the added base voltage has a negative voltage level, the positive voltage of the second driving signal outputted from the second stage isolation transformer unit can be much lowered. Therefore, the handling power of the second stage isolation transformer unit may be greatly decreased, and the transformer size can be significantly reduced, so as to reduce cost and the area of PCB. It achieves the LED driving module with higher power conversion efficiency and lower cost.

Figure 6:
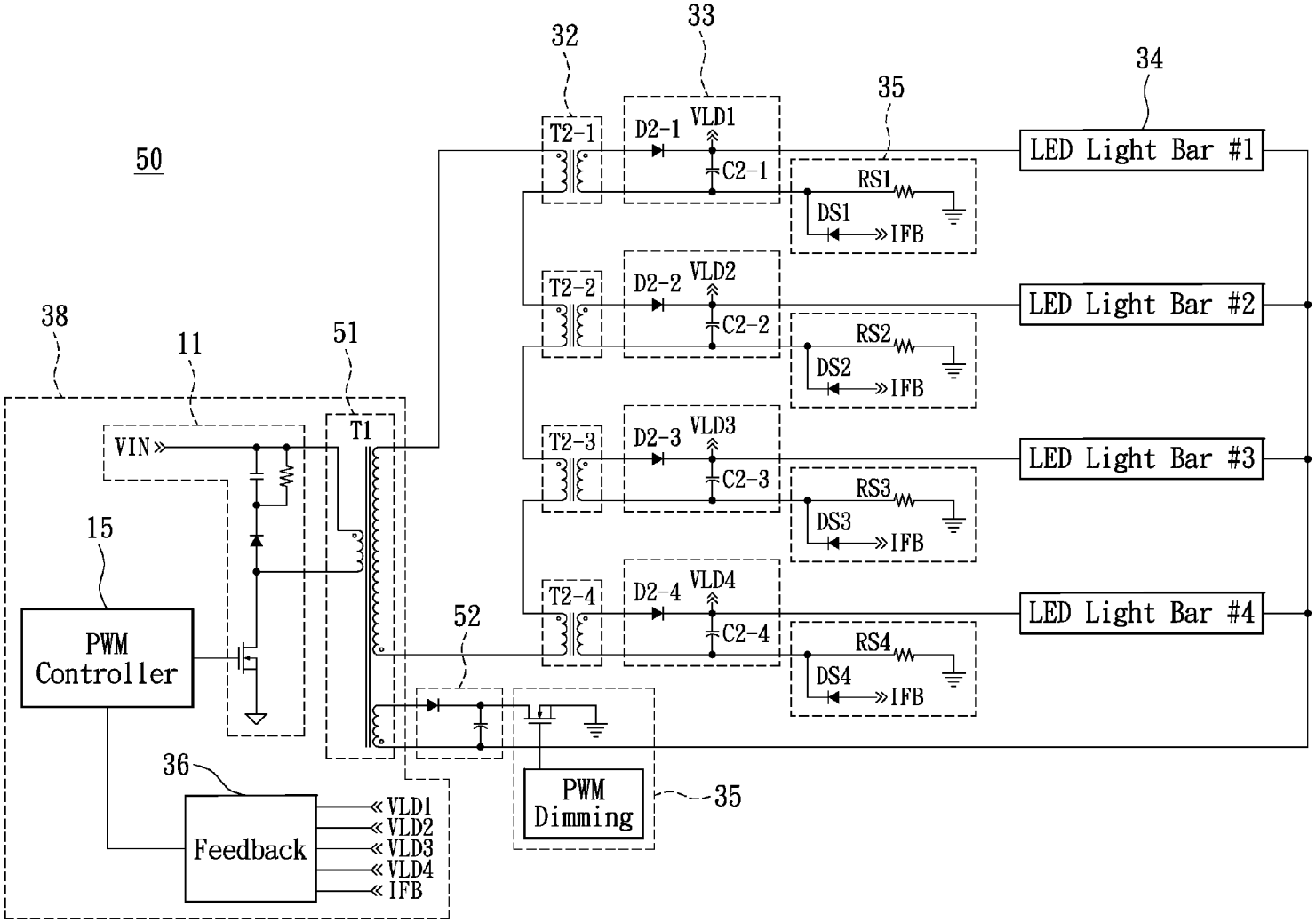
FIG. 6 shows a circuit diagram of the LED backlight driving module of the second embodiment in accordance with the instant disclosure.

Reference is made to FIG. 6, which is a circuit diagram example of the driving module 50 shown in FIG. 5. The first power isolation transformer 51 particularly includes a first secondary-winding and a second secondary-winding. Further, the primary winding of the plurality of second power isolation transformers 32 are interconnected in series, and the first secondary-winding of the first power isolation transformers 51 and the plurality of the second power isolation transformers 32 are connected in parallel.

The shown base voltage output rectifier and filter 52 uses a negative end of the second secondary-winding of the transformer 51 to induce a base voltage signal, where this base voltage signal is coupled to one end of the LED light bars 34. The majority of the voltages applied on these LED light bars 34 are provided by this base voltage signal. That means each of the second driving signals from the second power isolation transformers 32 is performed on one side of each LED light bar 34 correspondingly. The base voltage signal from the base voltage output rectifier and filter 52 is performed on the other sides of the LED light bars 34. The described second driving signal and the base voltage signal thus are combined to generate an optimum voltage difference for driving the LED light bars 34, so as to lowering the positive voltage level of the second driving signal.

Via the base voltage output rectifier and filter 52, the handling power of the second power isolation transformers 32 can be greatly decreased, and hence reduce the conversion loss. Therefore, the driving module (50) of the invention can reduce the cost of the transformers 32, and obtain a great power conversion efficiency.

To the skilled person in the art, the described plural second power isolation transformers 32 which are interconnected in series and the base voltage output rectifiers and filters 52 can be implemented in different embodiments separately. Therefore, the invention achieves the various objectives and purposes.

Figure 7:
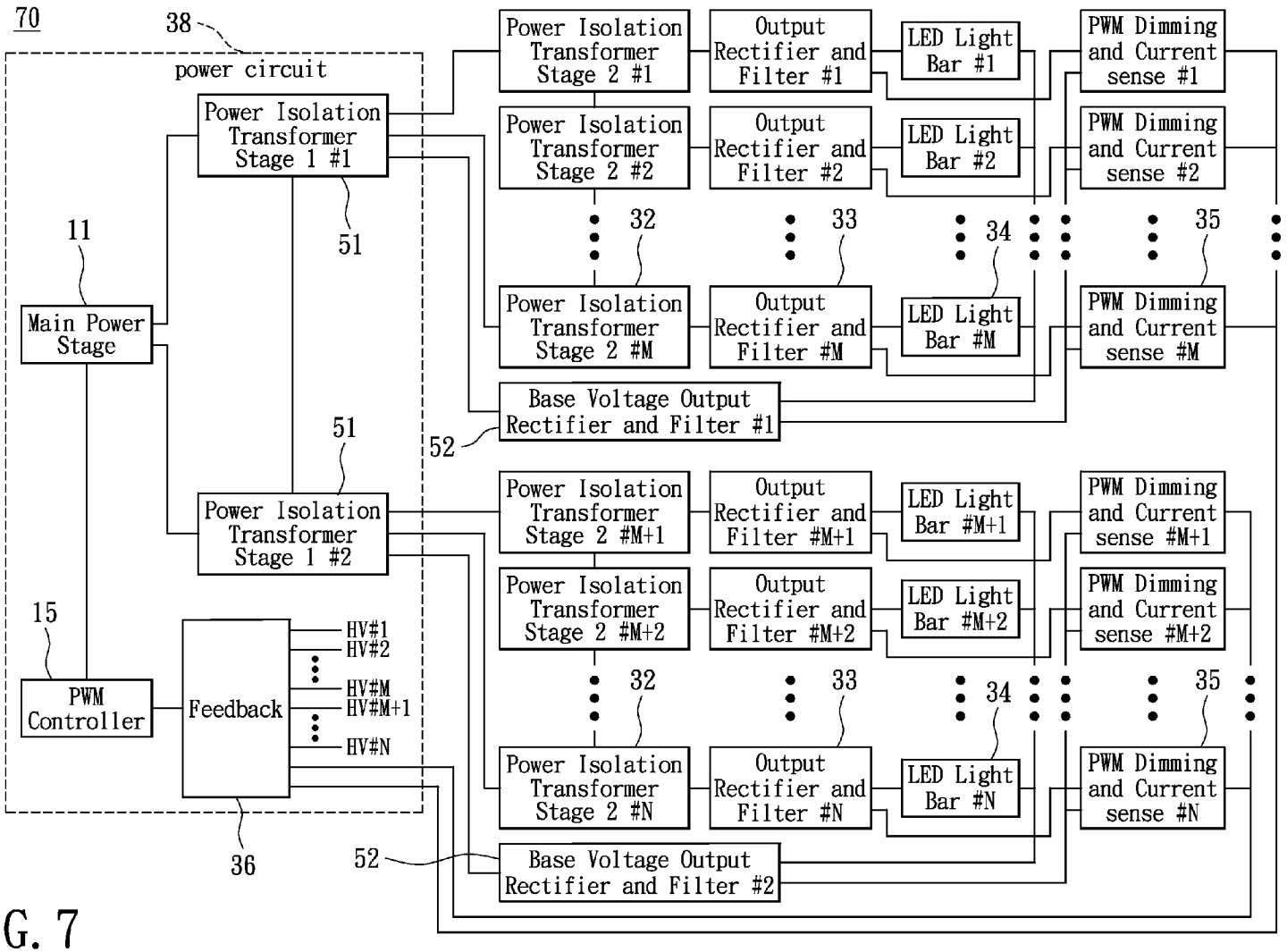
FIG. 7 Illustrates the block diagram of the LED backlight driving module of the third embodiment in accordance with the instant disclosure.
Figure 8:
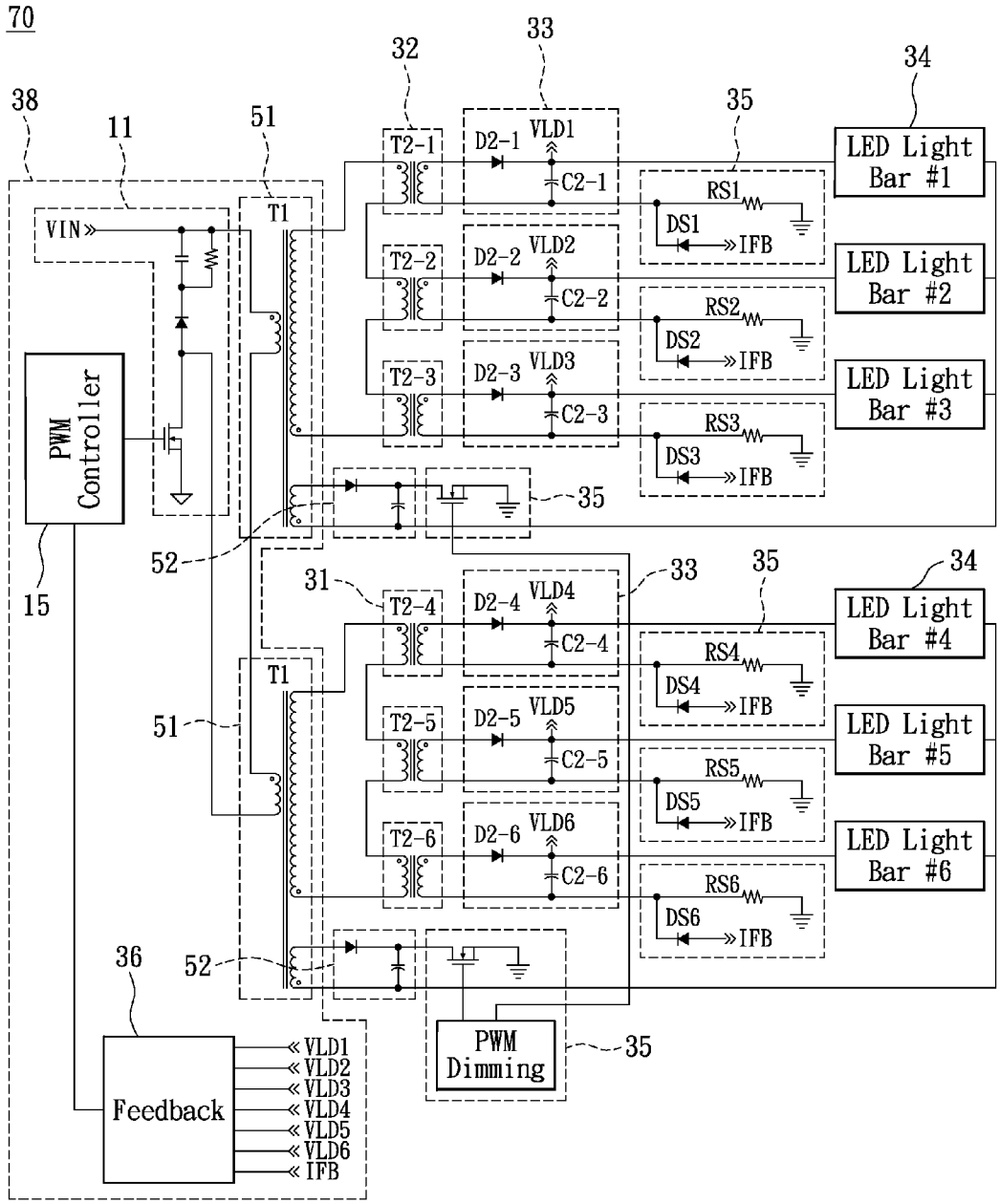
FIG. 8 shows a circuit diagram of the LED backlight driving module of the third embodiment in accordance with the instant disclosure.

References are particularly made to FIG. 7 and FIG. 8. A third embodiment of the instant disclosure regarding a driving module 70 for two first power isolation transformers (#1, #2)

51, and its application is schematically shown. It is noted that the number of the first power isolation transformers (51) of the first stage isolation transformer unit is adjustable in the above-mentioned second embodiment in order to apply on the corresponding number of the LED light bars (#1, #2, #3 . . . #M, #M+1, #M+2 . . . #N) (34). In the current embodiment, the primary winding of the two first power isolation transformers 51 are connected in series. Further, the primary windings of the second power isolation transformers 32 corresponding to the first power isolation transformers 51 are interconnected in series.

Through the in-series connected primary winding, the first secondary-winding of the two first power isolation transformers (#1 and #2) 51 may induce the first driving signals with the same current value. Furthermore, the in-series connected primary windings of the transformers 32 may also make the secondary winding of the second power isolation transformers 32 induce the same second driving signals with the same current value. Therefore, an uniform current may be achieved, and used to drive the LED light bars 34 to light uniformly.

Further reference in the current embodiment, the two base voltage output rectifiers and filters (#1, #2) 52 induce the base voltage signals via the negative ends of second secondary-windings of the first power isolation transformers (#1, #2) 51. Thus each of the positive voltage level of the second driving signals can be decreased. Thereby, the circuitry constitutes the LED backlight driving apparatus having a great power conversion efficiency and lower cost.

Figure 9:
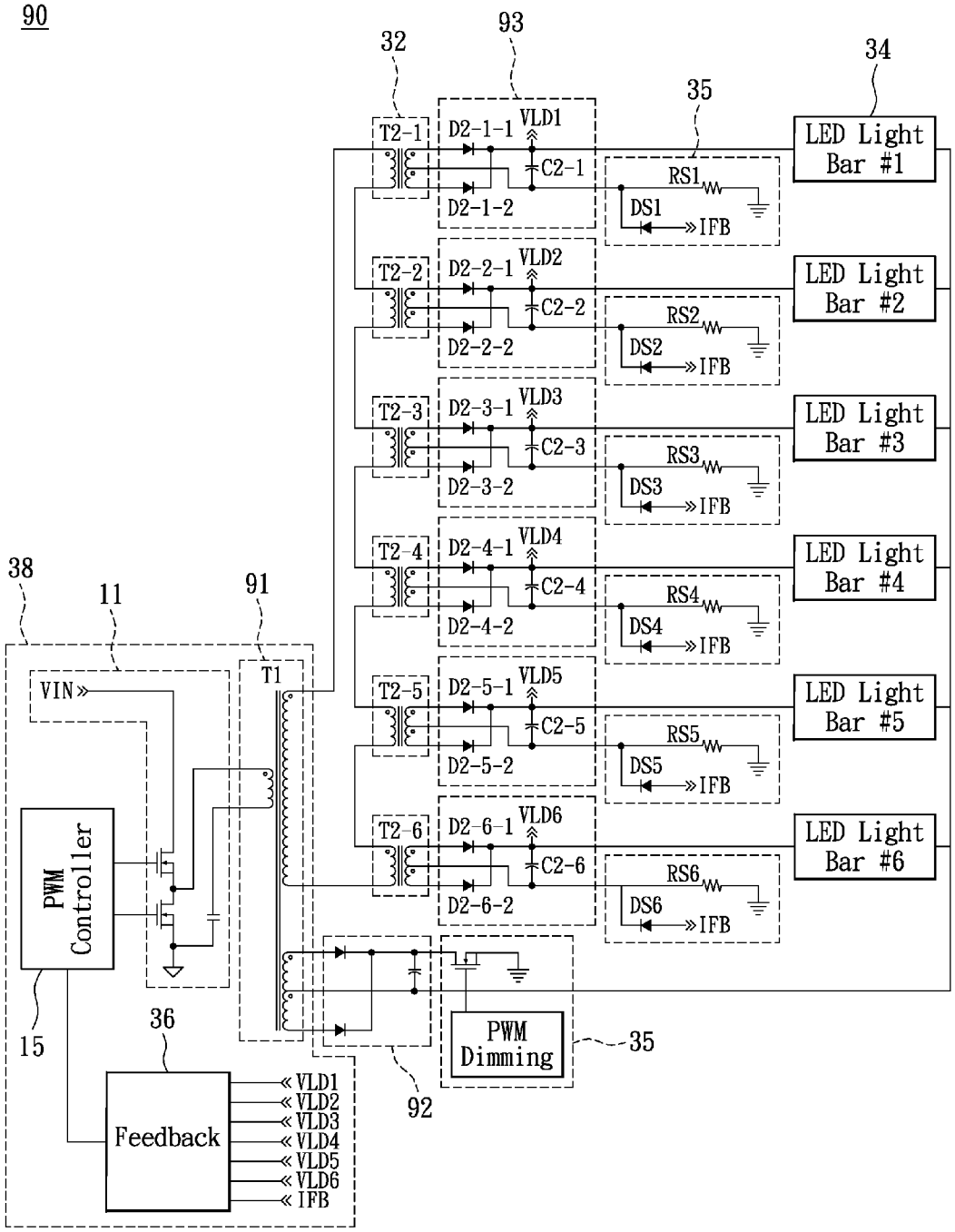
FIG. 9 shows a circuit diagram of the LED backlight driving module using an LLC resonant converter topology in the fourth embodiment according to the instant disclosure.

FIG. 9 shows the fourth embodiment of the instant disclosure. A driving module 90 used to drive the LED light bars (#1, #2, #3 . . . #6) 34 with a LLC resonant power source is particularly shown. In which, the connected primary windings of the second power isolation transformers 32, just like the circuit shown in the second embodiment, are provided to implement the purpose of uniform current. The base voltage circuit 92 also supplies a base voltage signal, and has a sufficient voltage difference between the LED light bars 34. The base voltage signals can be used to decrease the positive voltage level of the second driving signal. Consequently, the instant disclosure may be comprehensively applied to any topology of the conventional power supplies.

While the above description constitutes the preferred embodiment of the instant disclosure, it should be appreciated that the invention may be modified without departing from the proper scope or fair meaning of the accompanying claims. Various other advantages of the instant disclosure will become apparent to those skilled in the art after having the benefit of studying the foregoing text and drawings taken in conjunction with the following claims.

What is claimed is:

1. A LED backlight driving module for driving a plurality of LED light bars, comprising:

a main power stage generating a power signal;

a first stage isolation transformer unit coupled to the main power stage for receiving the power signal and outputting a first driving signal;

a second stage isolation transformer unit having a plurality of second power isolation transformers, wherein primary windings of the second power isolation transformers are interconnected in series, and first secondary-windings of the first stage isolation transformer unit and the second stage isolation transformer unit are connected in parallel, and a secondary winding of the second power isolation transformer generates a second driving signal corresponding to the first driving signal; and a plurality of output rectifiers and filters individually coupled to the secondary winding of the corresponding second power isolation transformer to perform rectification and filtering on the corresponding second driving signal to drive the correspondingly coupled LED light bars;

wherein the first stage isolation transformer unit is composed of a plurality of first power isolation transformers, and primary windings of the first power isolation transformers are connected in series so that the first driving signals of a same current value are induced on secondary windings of the first power isolation transformers respectively corresponding to the primary windings of the first isolation transformers.

2. The driving module of claim 1, wherein the plurality of the second driving signals have the same current value, which drive the corresponding LED light bars to generate a uniform luminance.

3. A LED backlight driving module, for driving a plurality of LED light bars, comprising:

a main power stage generating a power signal;

a first stage isolation transformer unit coupled to the main power stage for receiving the power signal and using a first secondary-winding to induce a first driving signal;

a second stage isolation transformer unit having a plurality of second power isolation transformers, wherein the first secondary-winding of the first stage isolation transformer unit and the second stage isolation transformer unit are connected in parallel, wherein a secondary winding of the second power isolation transformer generates a second driving signal corresponding to the first driving signal;

a plurality of output rectifiers and filters respectively coupled to the secondary windings of the corresponding second power isolation transformers to perform rectification and filtering on the corresponding second driving signals, wherein each of the corresponding output rectifiers and filters are coupled to a first end of the corresponding LED light bar; and a base voltage circuit coupled to a second end of the corresponding LED light bar, wherein a negative-voltage terminal of a second secondary-winding of the first stage isolation transformer unit induces a base voltage, and the coupled LED light bars are driven with the corresponding second driving signals.

4. The driving module of claim 3, wherein each of the LED light bars has a breakover voltage error, and the voltage level of the second driving signal is 1.5 to 2.5 times of the breakover voltage error.

5. The driving module of claim 3, wherein the base voltage has a negative voltage level.

6. A LED backlight driving module, for driving a plurality of LED light bars, comprising:

a main power stage generating a power signal;

a first stage isolation transformer unit coupled to the main power stage for receiving the power signal and outputting a first driving signal;

a second stage isolation transformer unit having a plurality of second power isolation transformers, wherein primary windings of the second power isolation transformers are interconnected in series and then connected to a first secondary-winding of the first stage isolation transformer unit in parallel, wherein the secondary winding of the second power isolation transformer generates a second driving signal corresponding to the first driving signal;

a plurality of output rectifiers and filters correspondingly coupled to the secondary windings of the second power isolation transformers to perform rectification and filtering on the corresponding second driving signals, wherein each of the corresponding output rectifiers and filters are coupled to a first end of the corresponding LED light bar; and a base voltage circuit coupled to second ends of the plurality of LED light bars, wherein a negative-voltage terminal of a second secondary-winding of the first stage isolation transformer unit induces a base voltage, and the plurality of LED light bars are driven with the corresponding second driving signals.

7. The driving module of claim 6, wherein the plurality of the second driving signals have the same current value, which drive the LED light bars to generate a uniform luminance.

8. The driving module of claim 6, wherein the first stage isolation transformer unit is composed of a plurality of first power isolation transformers, and primary windings of the first isolation transformers are connected with each other in series, and the first driving signals of a same current value are induced on the corresponding first secondary-windings.

9. The driving module of claim 6, wherein each LED light bar has a breakover voltage error, and the voltage level of the second driving signal is 1.5 to 2.5 times of the breakover voltage error.

10. The driving module of claim 6, wherein, the base voltage has a negative voltage level.

* * * * *